US010330325B2

(12) United States Patent
Cragar

(10) Patent No.: US 10,330,325 B2
(45) Date of Patent: Jun. 25, 2019

(54) WINE SIDE FIRE PIT

(71) Applicant: Steven William Cragar, Kirkland, WA (US)

(72) Inventor: Steven William Cragar, Kirkland, WA (US)

( * ) Notice: Subject to any disclaimer, the term of this patent is extended or adjusted under 35 U.S.C. 154(b) by 0 days.

(21) Appl. No.: 15/381,057

(22) Filed: Dec. 15, 2016

(65) Prior Publication Data

US 2018/0172283 A1 Jun. 21, 2018

(51) Int. Cl.

| | |
|---|---|
| ***F24B 1/18*** | (2006.01) |
| ***F24C 15/06*** | (2006.01) |
| ***F24C 15/00*** | (2006.01) |
| ***F24C 15/08*** | (2006.01) |
| ***F24C 15/02*** | (2006.01) |
| ***F24B 3/00*** | (2006.01) |

(52) U.S. Cl.

CPC ..... *F24C 15/06* (2013.01); *F24B 3/00* (2013.01); *F24C 15/001* (2013.01); *F24C 15/02* (2013.01); *F24C 15/08* (2013.01)

(58) Field of Classification Search

CPC ..... F24C 15/06; F24C 15/001; F24C 15/02; F24C 15/08

USPC ..... 126/500, 505, 506, 222, 225, 224, 29, 126/39 R, 25 R

See application file for complete search history.

(56) References Cited

U.S. PATENT DOCUMENTS

| | | | | |
|---|---|---|---|---|
| 5,094,223 | A * | 3/1992 | Gonzalez | F24B 15/005 126/25 B |
| D765,232 | S * | 8/2016 | Horsfield | D23/343 |
| 2011/0162634 | A1* | 7/2011 | Richard | A47J 37/0763 126/25 R |
| 2014/0174427 | A1* | 6/2014 | Yuen | A47J 37/0781 126/25 R |
| 2016/0033126 | A1* | 2/2016 | Lance | F21S 13/12 431/344 |

OTHER PUBLICATIONS

Rocky Mountain Naramata Fire Barrel. https://www.thebbqshop.com/index.cfm?DSP=ProductDetail&CategoryID=1242&SubCatID=0&ProductID=2951&pagepath=FIRE_PITS_FIRE_TABLES&id=13621. 2014.*

* cited by examiner

*Primary Examiner* — Vivek K Shirsat

(57) ABSTRACT

A novel integrated heating, decorative, utilitarian, portable, convertible, storable, fire top barrel; used/new fermentation barrels; comprising of interior storage options, fuel pipelines, ventilation, lighting options, convertible burners, and side tables/accessory options for space adjustments and portability. Novel flexibility to adjust the fire barrel to fit the environment through removable side tables/counter/sill/accessories, and the flexibility to swap designs for events, seasons, or any occasion or occurrence. Novel adjustable top selection to fit environmental needs for design and use. Ease of control by external and/or internal options of fuel line valve controls. Choices on igniting system for adjustable cost options. Utilization of barrel size variation to accommodate travel/utility/use needs.

3 Claims, 11 Drawing Sheets

WINE SIDE FIRE PIT

FIELD OF THE INVENTION

The present invention relates to a multiuse fire pits and fermentation barrels. Previous art only covers one design in the market, whereas my design will assist in filling a gap not yet realized in the changing market. The scope of the design aimed to first fill the needs of the winery's and local bar's and pub's, further to expand into the private market through exposure. The Wine Side is designed to fill the gaps in the market and provide options to grow with the changing market and styles.

BACKGROUND

A fermentation barrel US611003A is normally not correlated to fire pits or any standard thought of a countertop, heating, or cooking utility. The only current similarity, Wine Barrel Fire Table USD765232S1, has only a design style covered and does not cover the depth, style, and scope of said invention.

The common gas or wood alternative fire pit is not constructed of fermentation barrels, and the scope of said design is to fill a gap in the consumer market. The embodiment of the design providing alternative heating, utility, decoration, and other related uses for indoor and outdoor deployment. The barrels will also provide flexibility in deployment customization.

SUMMARY

It is a fire top fermentation barrel/container, heating/cooking, aesthetically adjustable, portable/fixed, designed for any standard need or environment.

It has optional novel feature inserts for surface, space, and design flexibility. The surfaces being quartered out to provide space adjustability being removed or inserted to fit changes in space needs or storage.

It has fuel lines that can be adjusted inside of the unit to fit consumer needs. The lines are designed to move fuel through the barrel and contain/s regulated control valve/s. The lines can be adjusted to internal and external fuel sources. The lines untimely leading to the top of the barrel design, providing the fuel to the output burner/burners.

It has door/s/removable panel/s to refill or access fuel control and storage. Said feature also to provide safety inspection access for controlled environments' and general consumer safety.

It has a novel configurable top burner options and designs to fit setting needs. Whereas to provide a centerpiece design for providing aesthetics for the environment and/or warming/cooking surface for consumers or consumer's clients.

It has optional installed transportation attachments' and/or handles/gripping surface. This being optionally integrated into the surface attachment slots/ports/connection areas.

It also has optional safety or aesthetic covers for the fuel burning surfaces. These said options can be adjusted to fit overall demand and customization of needs.

Adding up all the details of said invention would solve a large missing dynamic in the market. Whereas said invention providing flexibility to the consumer and adjustability in the investment of said invention. The consumer can adjust the base unit and add additional pieces as budget and needs change. Said invention would solve barrel use/reuse, consumer current and future needs, fill a gap, and provide growth within the current market.

BRIEF DESCRIPTION

Figure 3:
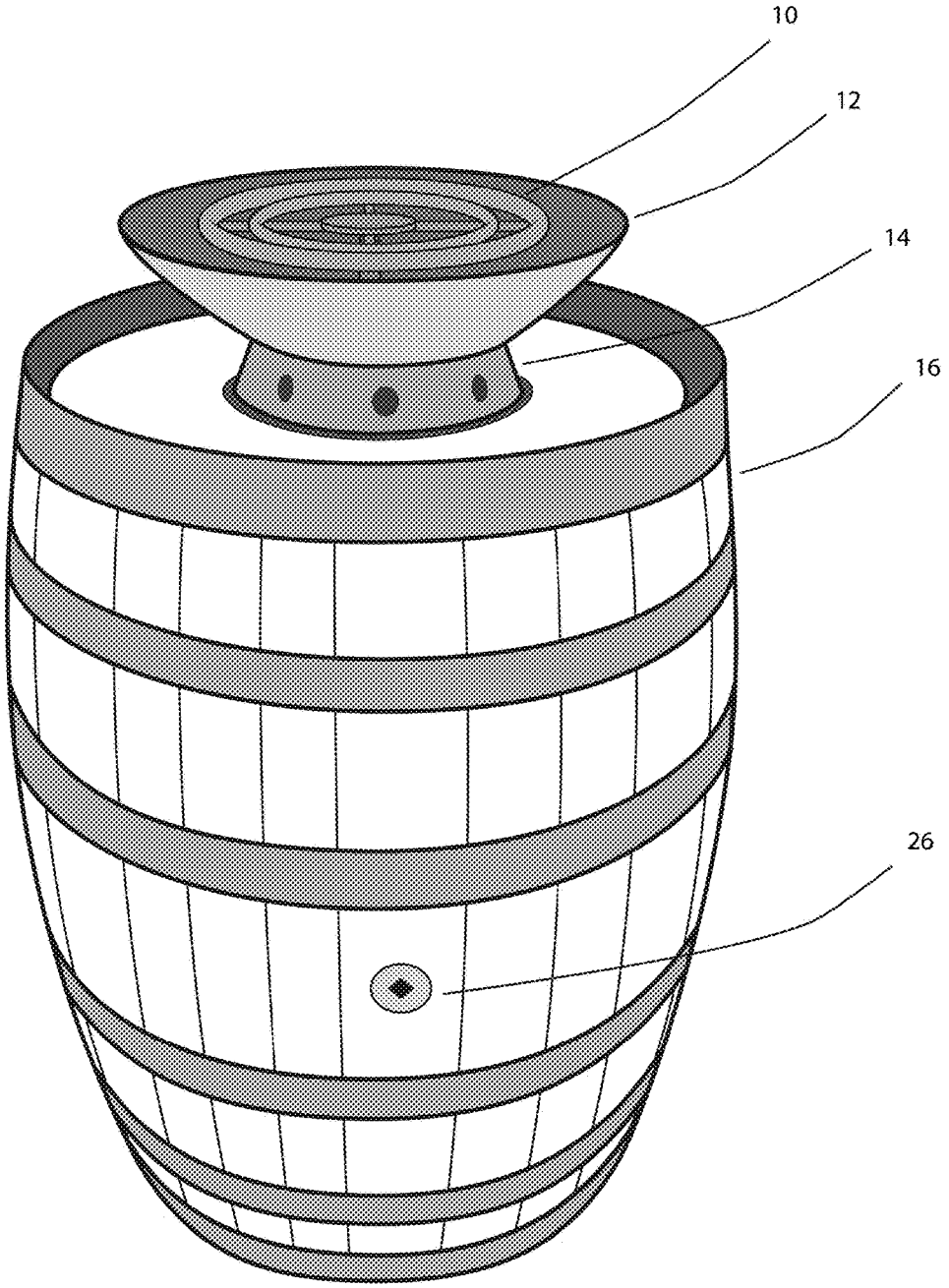

FIG. 3 reveals the back side of the barrel. Displaying an optional exterior facing key adjustment valve.

Figure 4:
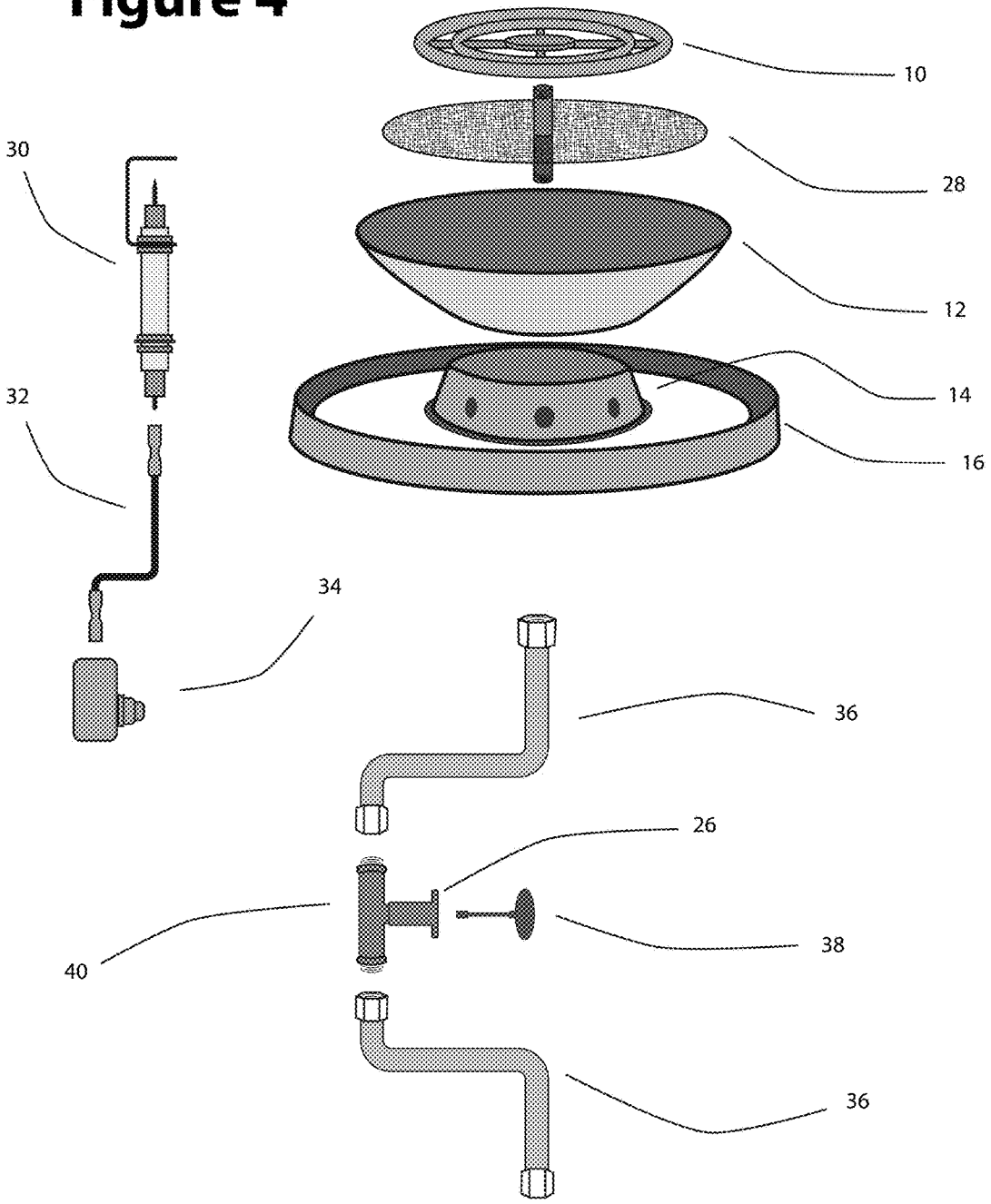

FIG. 4 is an exploded view of the options fuel system options of the fire barrel. Demonstrating a push button ignition system, cooling airflow layers, and fuel system control.

Figure 5:
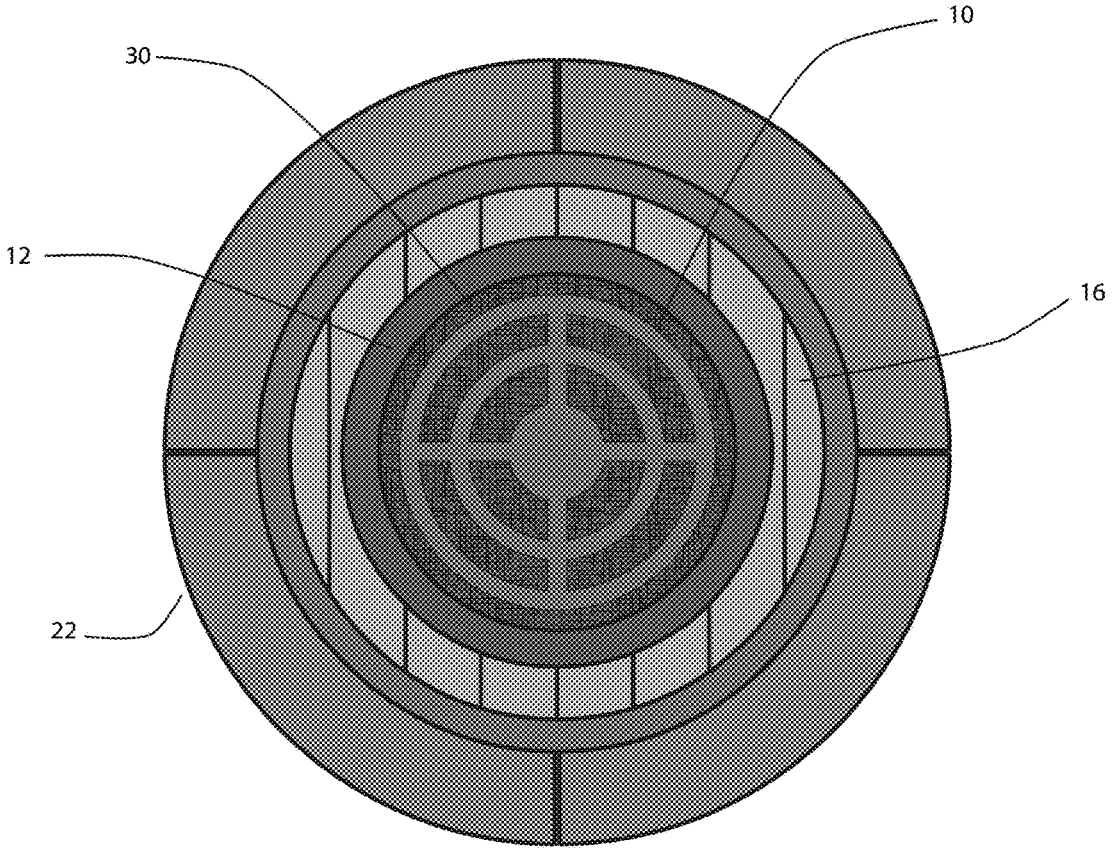

FIG. 5 displays a top view of the fire barrel and its optional leaf inserts in place.

Figure 6:
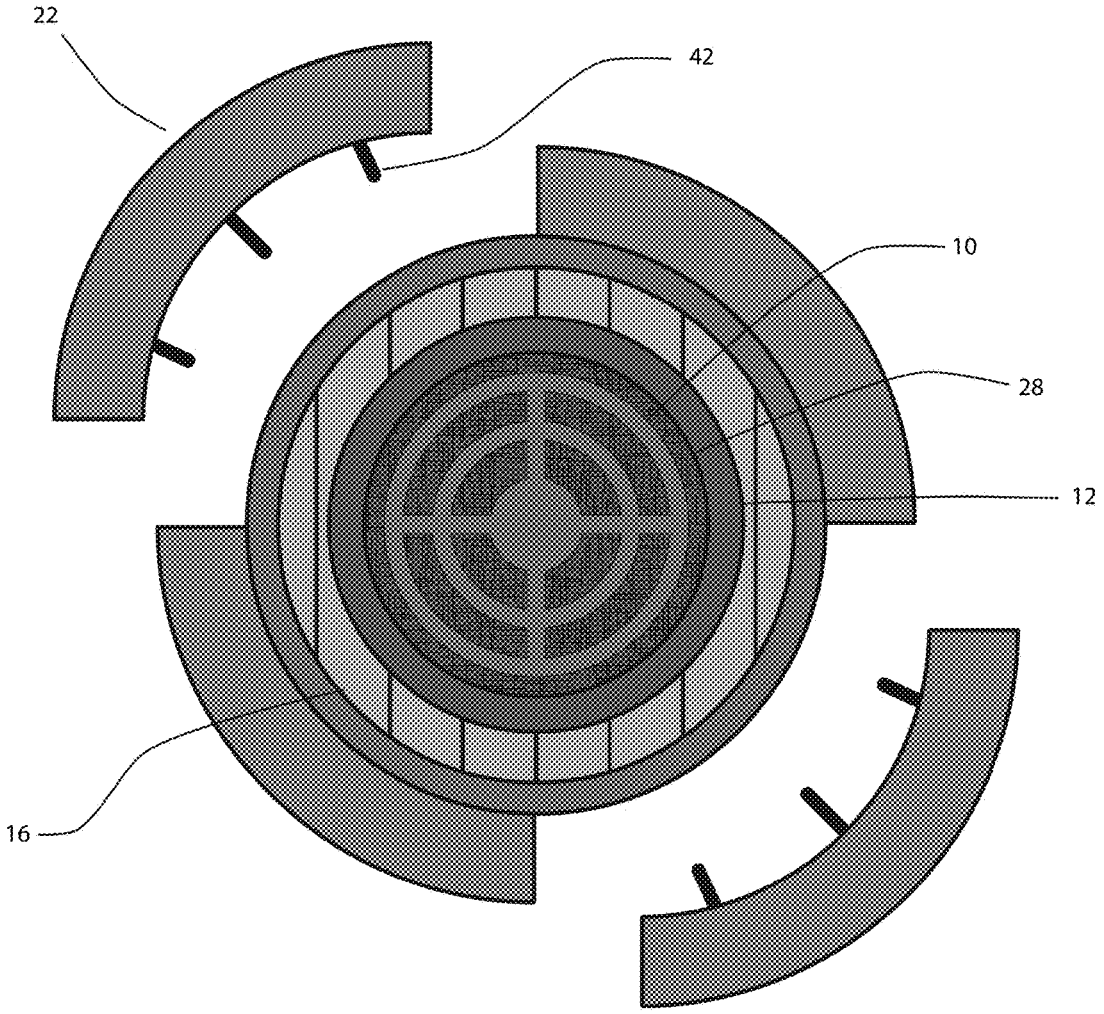

FIG. 6 shows two of the leaf inserts extracted for accommodation adjustments.

Figure 7:
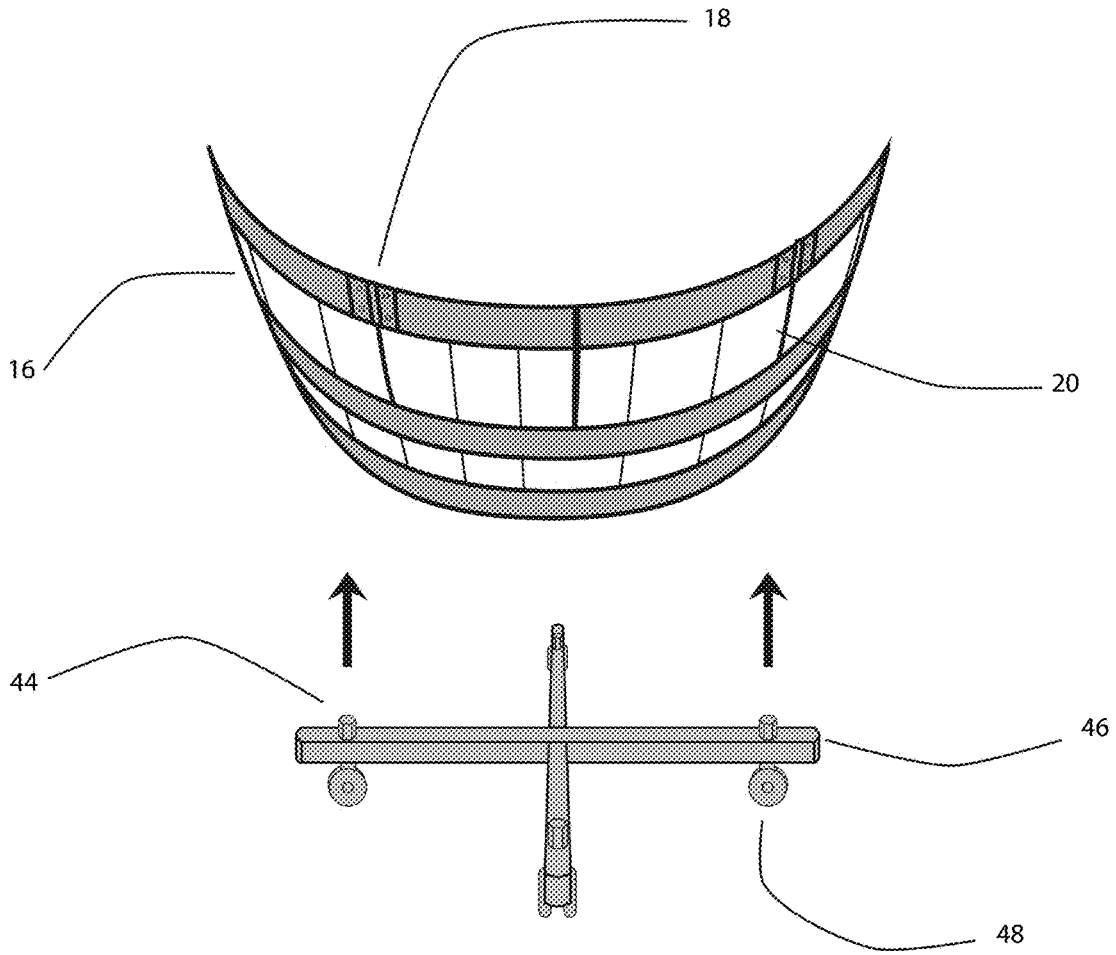

FIG. 7 is a diagram showing the wheel insert for mobility needs.

Figure 8:
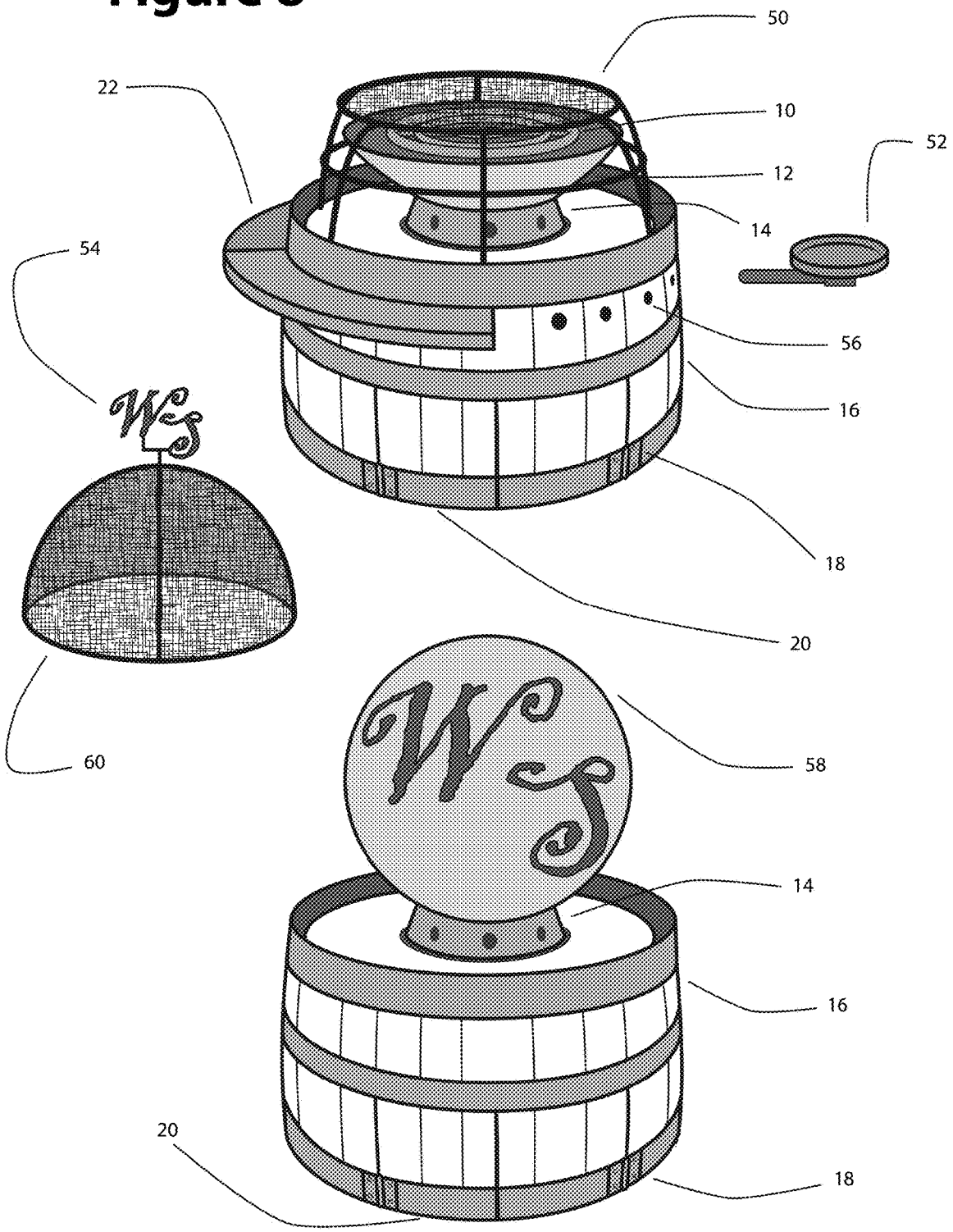

FIG. 8 displays optional accessories to fit needs of consumer's desires and/or demands.

Figure 9:
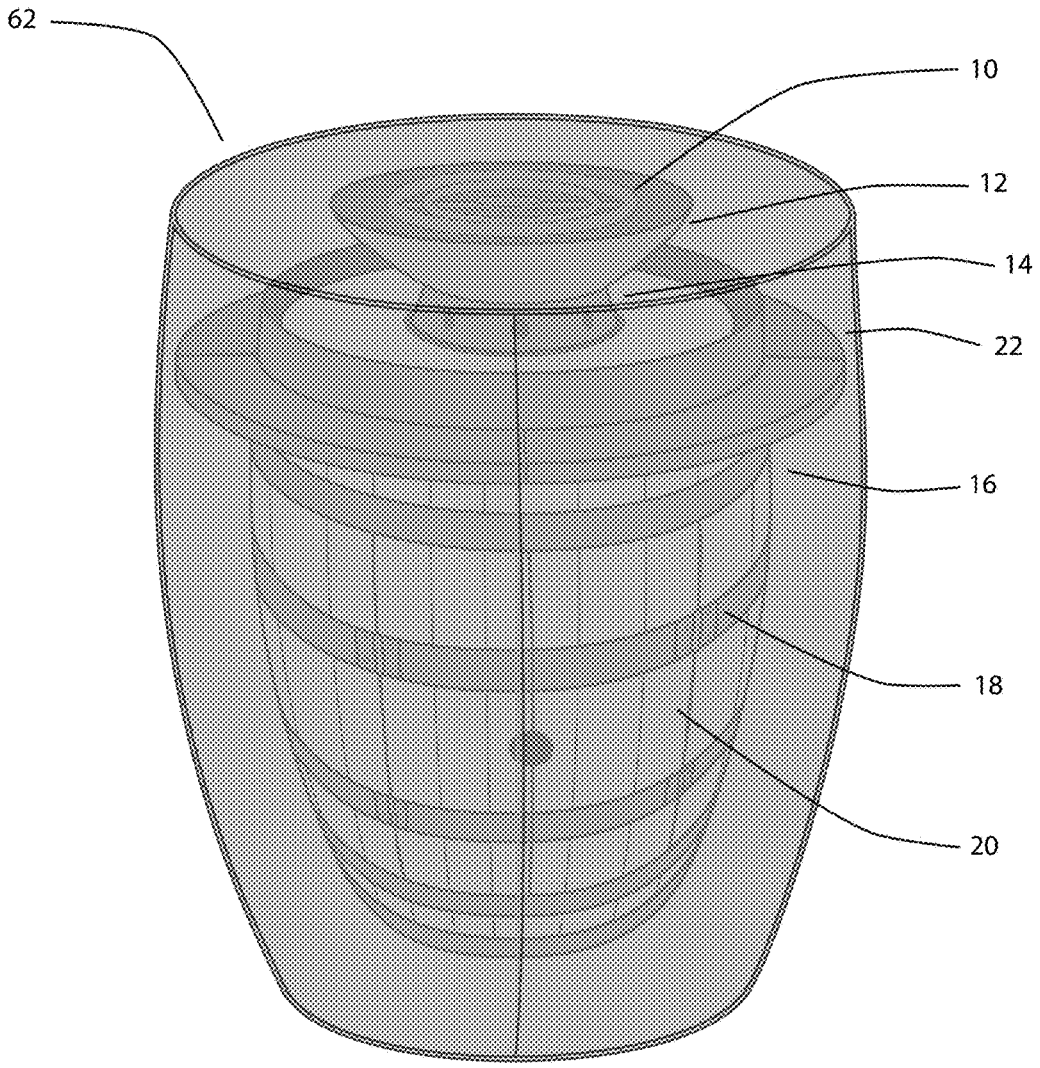

FIG. 9 conveys the basic version of investment protection from the elements.

Figure 10:
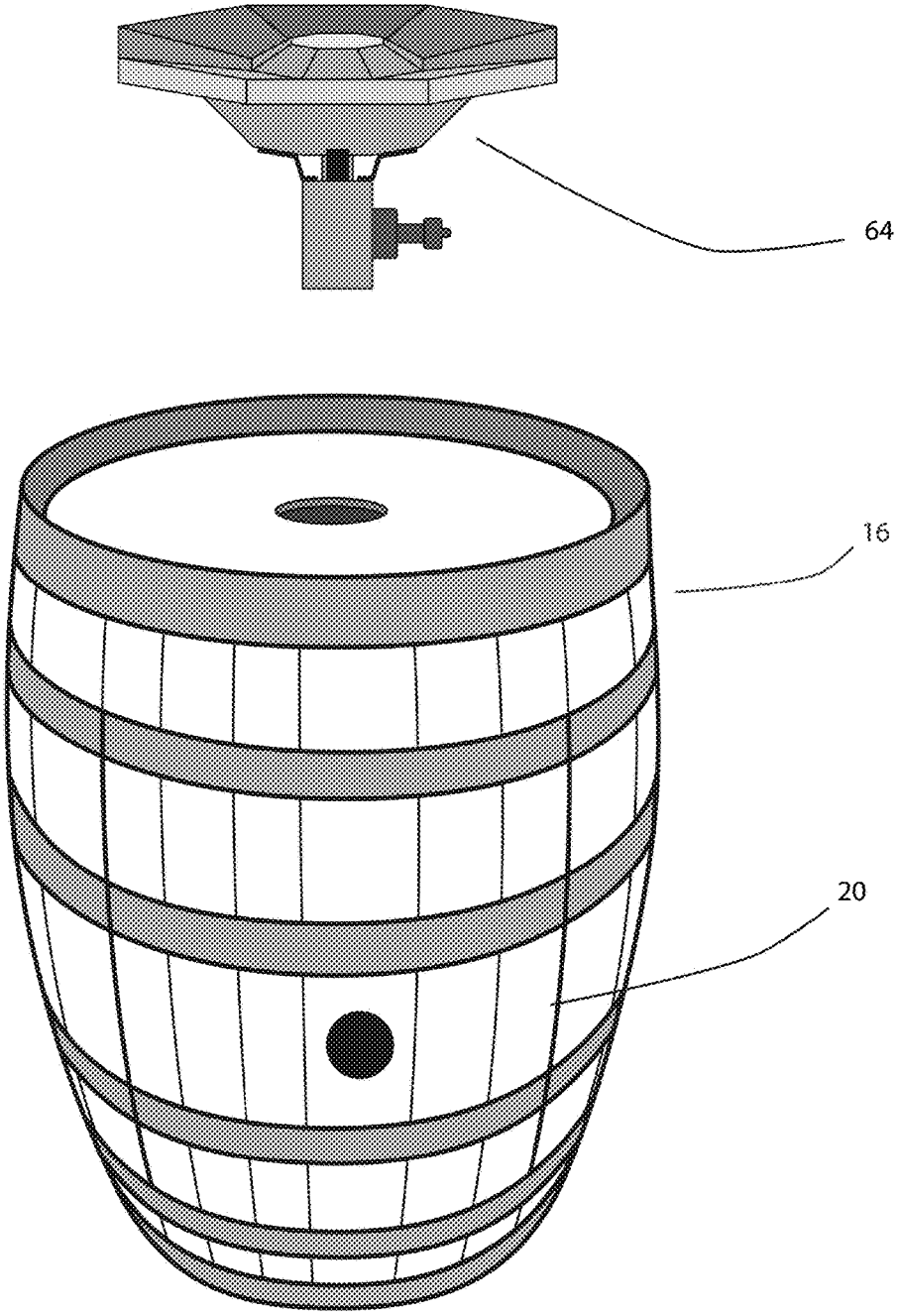

FIG. 10 is an example of a miniature fire barrel to be used in travel accommodations.

Figure 11:
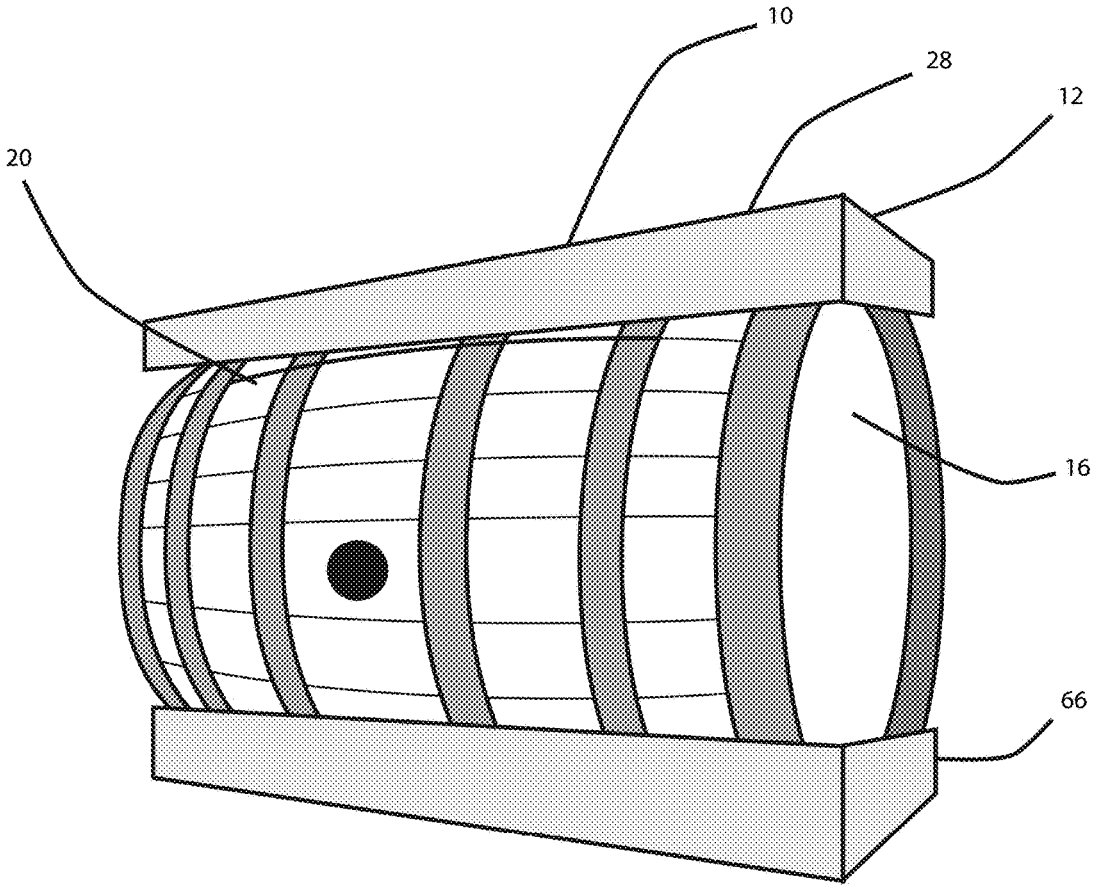

FIG. 11 displays another example to show versatility of the barrel configuration.

DETAILED DESCRIPTION OF THE PREFERRED EMBODIMENT

Figure 1:
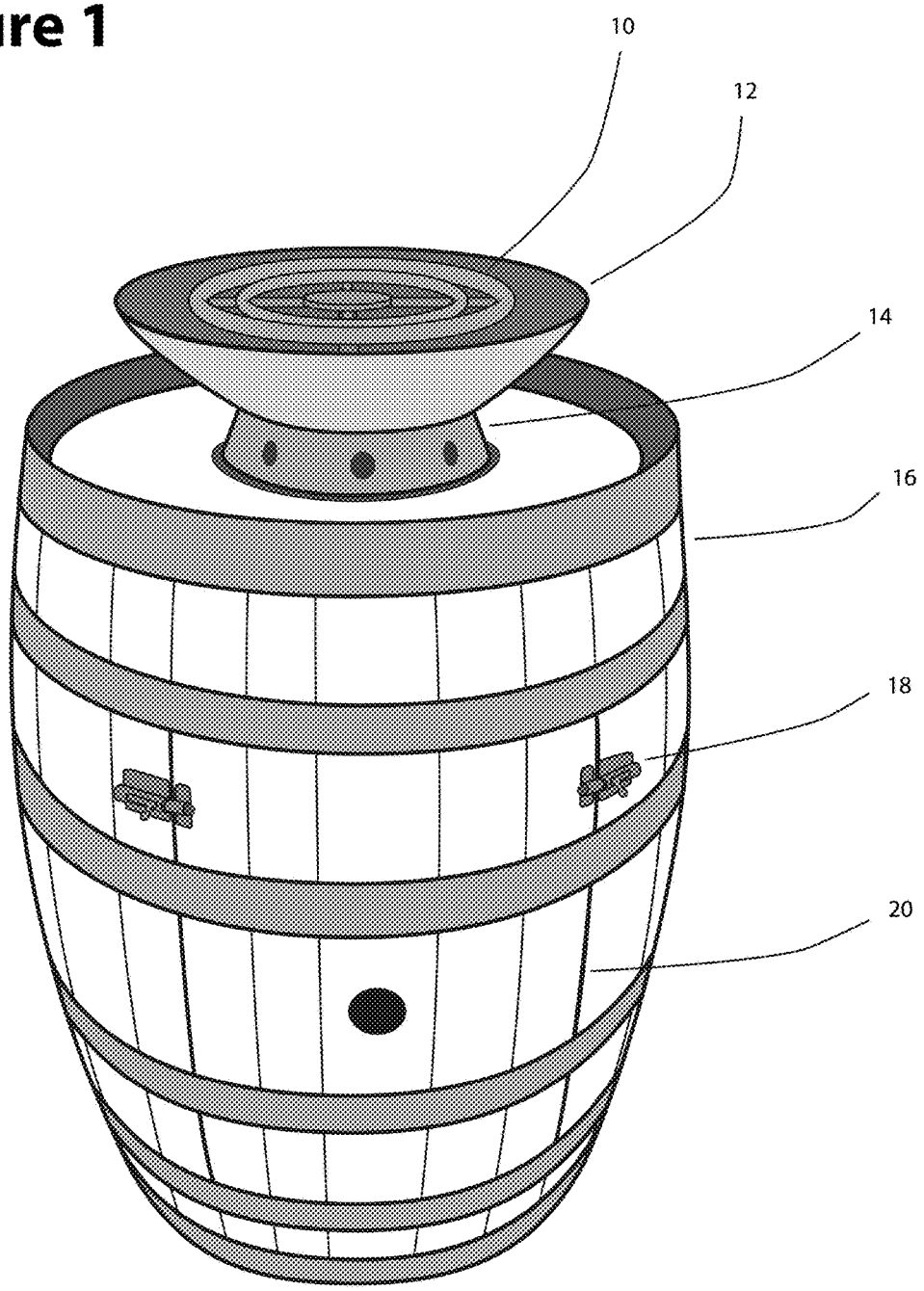
FIG. 1 is a basic fermentation fire barrel. This example shows a fire pit burner, container, heat dispersion, barrel, door latching/locking, and basic access panel/door.

Refer to FIG. 1 displaying a representation of the first prototype front view. Starting from the top down, Burner outlet 10 being the exit and burning point for the fuel, surrounded by the casing 12 that can hold and support accent pieces. These units are held up in the example by a ventilation system 14 to help keep the vessel cooler while in use. The main fermentation barrel 16 acts as a host for these said parts of the preferred embodiment. Access to the fuel system is provided by a door/doors/access panel 20, to maintain, install, and in general provide and control access to the internals of the barrel.

Figure 2:
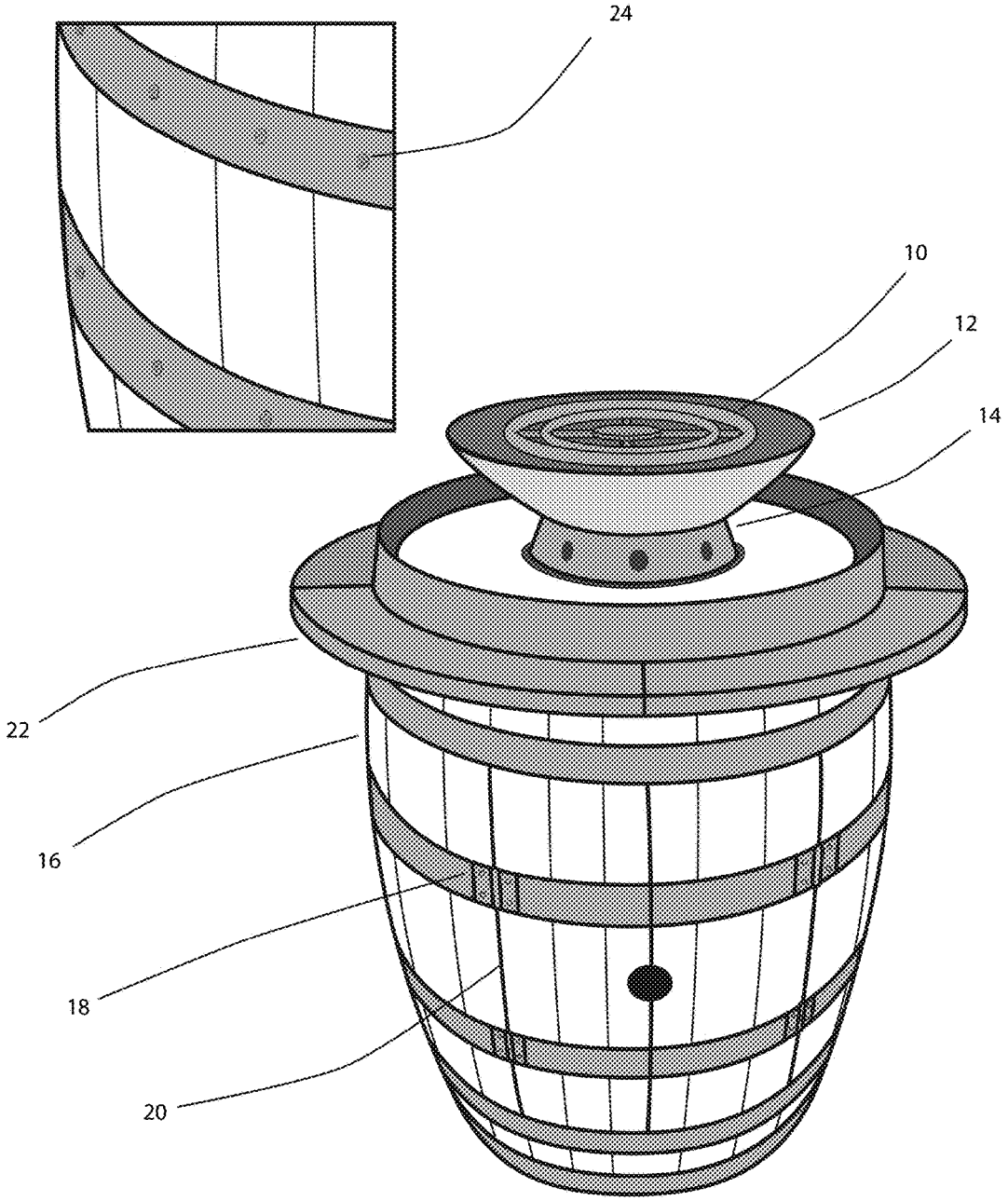
FIG. 2 Shows a close-up of the securing/reinforcement of the barrel, including an added table insert and door/access panel style type.

Refer now to FIG. 2 the ring reinforcement 24 is a key part of the design. The metal rings must be secured to an adequate placement of the boards. This diagram also features another preferred embodiment of the design. The outer table inserts 22 have been inserted in this view. Also, featured in this unique example is the variation of access to the inner barrel. The metal rings have been halved 20 and hinges 18 attached to each side.

Refer now to FIG. 3 is a rear view of the barrel, featuring an optional placement of the key fuel valve 26. Depending on the consumer use of the barrel, these options can be customized for aesthetic or any other custom needs.

Refer now to FIG. 4 is an exploded view of the fuel and optional ignition system. Starting from the top. The burner 10 sit just above an optional mesh to hold optional decorative fill over the burner, while still providing proper fuel and air mixture, with the added benefit of cooling for the holding unit 12. These units being surrounded by the ventilation system 14. The total embodiment of these units can be adjusted to fit the design or needs of the consumer and match the barrel 16 or environment they will be utilized within. The next segment of parts represents an optional addition of a spark ignition system for the fuel. The spark generator 30 can be attached to ignite the fuel coming from the burner 10. The electrical lines 32 run down to the spark control 34. Several options are available to adapt to each type of burner 10 design. The fuel system is referenced next. The first fuel line 36 connects to the base of the burner 10, 28, 12, 14, 16 embodiments, leading to the key valve 40, optional key valve cover 26, key 38, then connecting to the final fuel line 36, then leading to the optional fuel sources. Note that the system will need to be adjusted for fuel source differences. An example is natural gas versus propane. Each offering unique differences for design uses.

Refer now to FIG. 5 showing a top view with inserted table/counter surface 22. This view illustrates one design option that could be used to complete the unit.

Refer now to FIG. 6 illustrating the removable table/counter surface 22, exposing the support insert attachments 42. The unique removable design is to accommodate changes in the environment and use. This can be to accommodate transportation for events and other needs of mobility, or just simply to save on surface area to accommodate smaller spaces.

Refer now to FIG. 7. showing optional mobility enhancer. The pegs 44 of the wheel 48 base 46 can be inserted into the bottom of the barrel and provide ease of mobility for each unit. These mobility units can also be permanently installed for consumers that require constant mobility.

Refer now to FIG. 8 demonstrating accessories and design options for any fire barrel need or desire. Starting at the top of the page, you see a unique grill 50 that can be placed over the burner 10 to provide a functional cooking surface. This illustration also features a unique glass holder/mini table 52 insert that can be inserted around a customized barrel 56. The next accessory is a cover 60 designed to cover the flames. This cover features optional handle 54 customizations featuring my unique examples, initials in this case, WS standing for Wine Side. These covers can be customized to fit customer needs, including custom logo handles. Another example of this unique type of customization is the design being carved into a container 58 for the flames, so that the flames light up the design.

Refer now to FIG. 9 demonstrating a cover 62 to protect the fire barrel 16 from the elements.

Refer now to FIG. 10 demonstrating a small version of the fire barrel 16. In this example the design is adjusted to fit the fuel system of a portable camping stove. This provides a unique support and storage container for traveling stove units and accessories. This smaller example is cut open to insert the fuel for the smaller burner 64.

Refer now to FIG. 11 demonstrating an alternate configuration of the fermentation barrel on its side. This is to assist with a consumer needing a larger space to accommodate more guests, or to fill other needs, including but not limited to additional surface space with the customized table inserts 22. In this reference, all components of the pit 10, 28, 12 have been elongated to fit the design.

What is claimed:

1. A fire pit comprising:

a base comprising a plurality of longitudinal wooden boards circumferentially arranged so as to form a fermentation barrel, wherein the shape of the barrel is maintained by a plurality of reinforcement rings, each reinforcement ring positioned along a length of the fermentation barrel;

a door centrally positioned along the length of the fermentation barrel and supported by one of a hinge mounted to at least one of the plurality of reinforcement rings or a plurality of latches mounted to the longitudinal wooden boards, wherein the door allows for access to the interior of the fermentation barrel;

a plurality of apertures circumferentially located around the top of the fermentation barrel, the plurality of apertures located in between the top two reinforcement rings;

at least one table surface formed as an annular sector including at least one insert attachment, wherein the at least one insert attachment extends into at least one aperture of the plurality of apertures in order to support the at least one table surface on the fermentation barrel;

a burner disposed on the top surface of the fermentation barrel, such that a top surface of the burner is above the top surface of the barrel, the burner comprising a concave casing formed such that it can hold and support an accent piece, a burner outlet positioned at a top of the casing and configured to support a flame, and a ventilation system positioned between the burner casing and the top of the fermentation barrel, wherein the ventilation system is configured to reduce the temperature of the fermentation barrel while in use;

a fuel system located within the fermentation barrel, the fuel system comprising a fuel line attached to the burner, a fuel valve attached to the fuel line, where the fuel valve includes a valve cover which extends into an aperture centrally formed in the side of the fermentation barrel such that a fuel key can operate the fuel valve from the exterior of the fermentation barrel.

2. The fire pit according to claim 1, further comprising a grill positioned on the top surface of the fermentation barrel, the top surface of the grill located above the top surface of the burner.

3. The fire pit according to claim 1, further comprising a flame container positioned above the top surface of the fermentation barrel, the flame container comprising an aesthetic design carved into the container such that the flames illuminate the design.

* * * * *